United States Patent [19]
Raines et al.
[11] 4,394,955
[45] Jul. 26, 1983

[54] BAG WITH BENDABLE RETAINER STRIP, AND METHOD OF MAKING THE SAME

[75] Inventors: Charles D. Raines, Columbus, Ga.; Earl W. Williams, Phenix City, Ala.

[73] Assignee: Plicon Corporation, Columbus, Ga.

[21] Appl. No.: 236,337

[22] Filed: Feb. 20, 1981

[51] Int. Cl.[3] ..... B65D 33/02; B65D 33/06

[52] U.S. Cl. ..... 229/65; 150/7; 229/62; 493/215

[58] Field of Search ..... 229/62, 65; 150/7; 493/215

[56] References Cited

U.S. PATENT DOCUMENTS

| | | | |
|---|---|---|---|
| 594,235 | 11/1897 | Eaton | 229/65 |
| 1,979,157 | 10/1934 | Higginbottom | 229/65 |
| 2,018,228 | 10/1935 | Potdevin | 229/65 |
| 2,265,075 | 12/1941 | Knuetter | 229/61 X |
| 2,343,571 | 3/1944 | Nicolas | 229/65 |
| 2,480,500 | 8/1949 | Moore | 229/65 X |
| 2,572,683 | 10/1951 | Wachs | 150/29 |
| 2,656,769 | 10/1953 | Hultkrans | 229/63 X |
| 3,223,311 | 12/1965 | Becker et al. | 229/65 X |
| 3,289,723 | 12/1966 | Clark | 150/7 |
| 3,299,927 | 1/1967 | Clarizio | 229/62 X |
| 3,456,866 | 7/1969 | Cititello | 229/65 X |
| 3,688,973 | 9/1972 | Lillkvist | 229/65 X |

FOREIGN PATENT DOCUMENTS

| | | | |
|---|---|---|---|
| 1066791 | 1/1954 | France | 229/65 |

*Primary Examiner*—William Price
*Assistant Examiner*—Gary E. Elkins
*Attorney, Agent, or Firm*—Hill, Van Santen, Steadman, Chiara & Simpson

[57] ABSTRACT

A recloseable bag is provided with lip projection above the bag mouth and carrying a bendable retaining strip with opposite end tab extensions projecting into overhanging relation to clearance indentations in the side edges of the bag extending from adjacent to the lower edge of the lip portion downwardly to a substantial distance below the bag mouth opening so that the lip portion is adapted to be folded down over and into closing relation to the bag mouth opening and the tab extensions adapted to be bent over to maintain the bag closed. Gussets may be provided in the bag bottom to provide spreadable base under bag content load for supporting the loaded bag in upright position. A method of making the bag is disclosed.

16 Claims, 12 Drawing Figures

FIG. 1
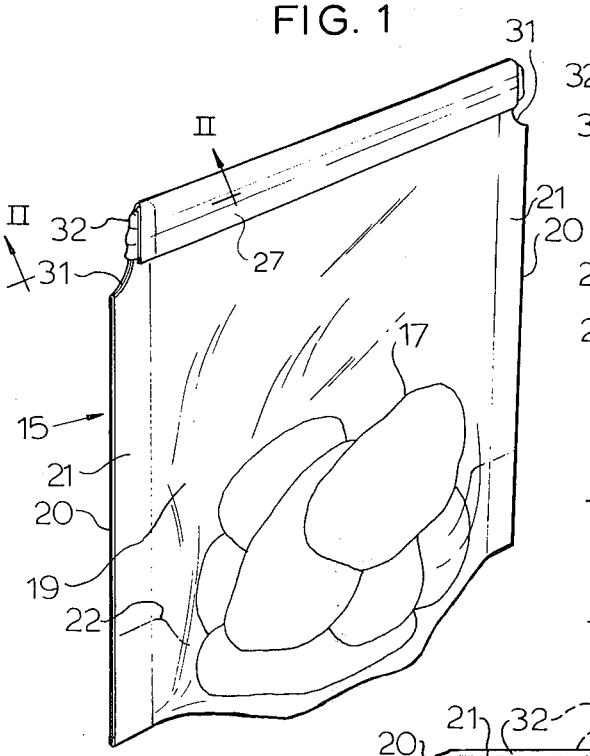
FIG 4
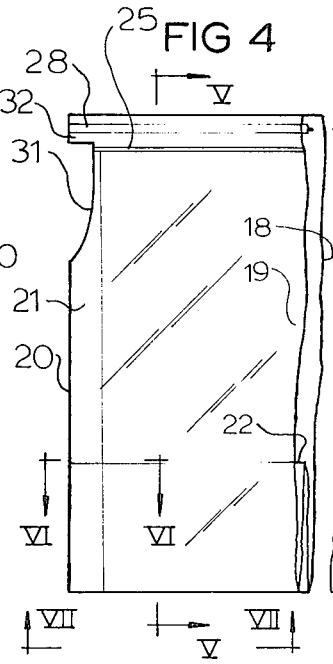
FIG. 4A
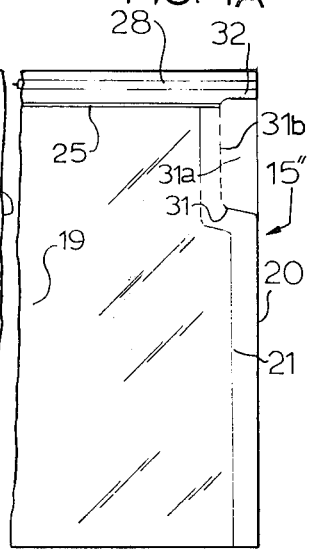
FIG. 2
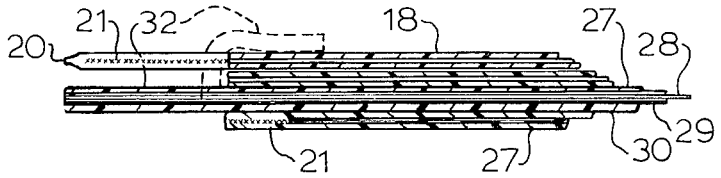
FIG. 3
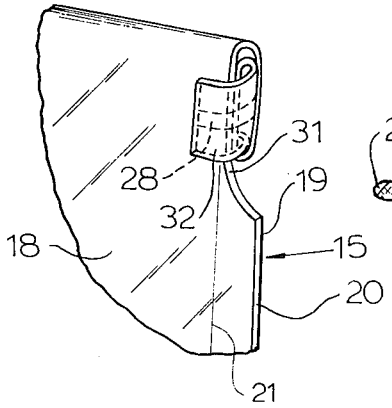
FIG. 6
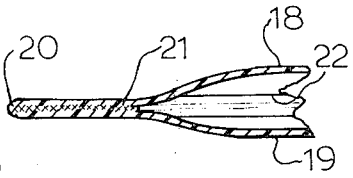
FIG. 7
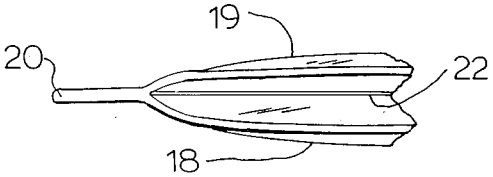
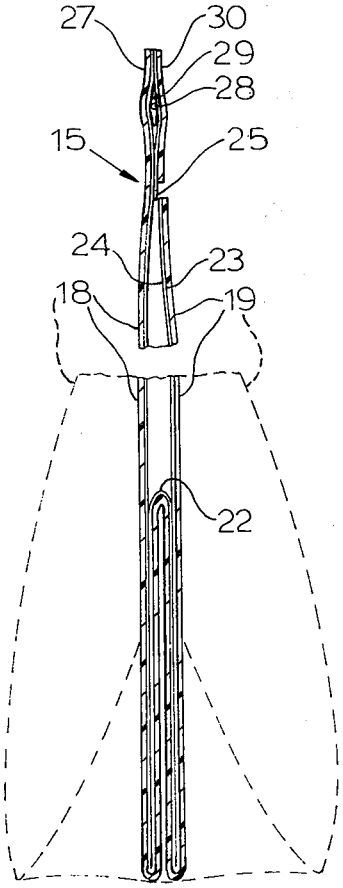
FIG. 5

BAG WITH BENDABLE RETAINER STRIP, AND METHOD OF MAKING THE SAME

This invention relates to bag structures and method of making the same, and is more particularly concerned with bags of the type provided with top closure, bendable retainer or tie means.

Bags or pouches having non-sealable and reopenable closure means in the form of bendable retainer or tie strip across their tops have had certain inherent disadvantages not only in respect to the structure itself but also in the manufacture of the structure. The retainers or ties consist of bendable strips, generally wire or embodying wire and with one or both opposite ends of the bendable strips projecting beyond the side edge or edges of the bag so that by rolling or folding the bag top down to close the bag opening or mouth and then bending the terminal ends of the strip over into retaining or locking relation, the bag can be maintained closed. To open the bag, the strips are bent back out of the retaining relation and the bag top rolled open.

A problem with prior structures has been that because the bendable ends of the ties project beyond the sides of the bags, it has been deemed necessary in manufacturing the bags to maintain a spaced relation of successive bags when applying the retainer tie strips as a continuous process, or to apply the strips individually to each bag separately. When packaging and storing the bags the laterally projecting retainer tie ends have been a nuisance, requiring some sort of side filler to compensate at the sides of the bags in a packet of the bags in a container, or taking the chance that the tie ends will become bent and misaligned in storage and handling. Further, when the tie ends are bent over to maintain the rolled top closed, there has been an objectionable sideward projection of the bent ends, specially where inexpertly or carelessly bent over.

It is to the alleviation of the foregoing and other problems that the present invention is directed.

It is, accordingly, an important object of the present invention to overcome the disadvantages, drawbacks, inefficiencies, shortcomings and problems inherent in prior bags and methods of making bags of the indicated type.

Another object of the invention is to provide a new and improved bag of the type indicated in which bendable retainer strip means are provided which will efficiently serve the intended purpose but which will avoid having any projections beyond the side edges of the bags either before or after use of the bendable retainer ties for the intended purpose.

A further object of the invention is to provide a new and improved method of making bags of the type indicated.

The present invention provides a bag of the type having opposed first and second bag walls with their opposite vertical edges and their bottom edges attached to one another to provide a bag having a top bag mouth opening, and comprising, a substantial portion of said first bag wall projecting above said second bag wall and thereby above said bag mouth opening; a bendable retainer strip carried by and extending across the upwardly projecting portion of said first wall; clearance indentations in the side edges of the bag extending from adjacent to the lower edge of said upwardly projecting first wall portion downwardly to a substantial distance below said bag mouth opening; and opposite end tab extensions of said strip projecting into overhanging relation to said indentations so that said upwardly projecting first wall portion is adapted to be folded over into closing relation to said bag mouth opening and onto the outer face of said second wall, and said tab extensions being then adapted to be bent over onto the outer face of said first wall for maintaining the bag closed, but permitting the bag to be reopened by bending said tab extensions out of engagement with said first wall and unfolding said projecting portion away from said bag mouth opening.

The present invention also provides a new and improved method of making the foregoing bag.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a perspective view of a bag embodying the invention;

FIG. 2 is an enlarged fragmentary sectional detail view taken along the line II—II of FIG. 1;

FIG. 3 is a perspective view of the rear of the upper left corner of the bag shown in FIG. 1;

FIG. 4 is a fragmentary front elevational view of a side portion of the bag;

FIG. 4A is a fragmentary front elevational view of a side portion of a slight modification of the bag;

FIG. 5 is a vertical sectional detail view taken substantially along the line V—V of FIG. 4;

FIG. 6 is a fragmentary sectional detail view taken substantially along the line VI—VI of FIG. 4;

FIG. 7 is a fragmentary bottom edge view of the bag taken substantially in the plane of line VII—VII of FIG. 4;

Figure 8:
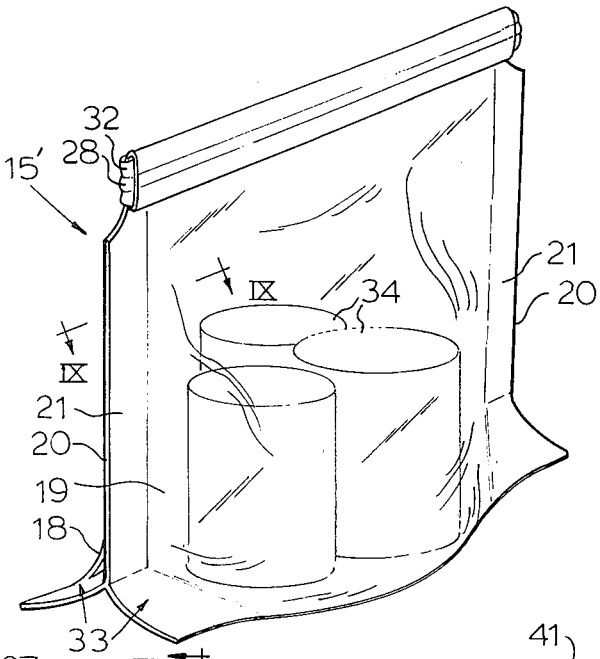
FIG. 8 is a perspective view of a slightly modified form of the bag.

A bag 15 (FIG. 1) embodying the invention may be adapted for contents 17 of diverse character and may be made from a variety of different materials suitable for whatever contents are to be packaged within the pouch provided by the bag. By way of example and not limitation, the contents 17 may be small hardware parts or a single part, foodstuff, flowable particulate solid or liquid materials or combinations thereof, etc. Materials from which the bag 15 may be made comprise, without limitation, various suitable plastic film materials, paper, metal foil, and the like. The bag is especially suited to be made from an insulating outer ply and a sealant inner ply. The outer ply may be, but not limited to, cellophane, paper, polyester, nylon, metal foil, polypropylene film, high density polyethylene film, and the like. The inner ply may be, without limitation, polyethylene film, polypropylene film, polyester film, surlyn film, especially suitable for heat sealing and laminated or coated onto the outer ply. Any number of plies may be employed as conditions warrant or require.

In one preferred construction, the bag 15 comprises a first wall 18 (FIGS. 1, 4 and 5) and an opposed second wall 19. The bag walls 18 and 19 are attached to one another along their opposite joined edges 20 by means of respective seals 21 which may be adhesively bonded seals or heat seals depending on the material, use requirements, etc. At their bottom edges, the bag walls 18 and 19 are attached to one another in desirable manner to form with the attached side eges a closed pouch, and for purpose of accommodating a large mass of contents the bottom edges may be formed with a closure gusset 22 provided by infolding bottom edge portions of the panels providing the walls 18 and 19 and which bottom edge portions are desirably monolithically connected in one continuous piece. Thereby the bag 15 can be formed up from sheet material, the sidewalls 18 and 19 being folded toward one another and the gusset tucked in between the lower portions of the panels 18 and 19. It may also be noted that, as best seen in FIG. 1, the opposite ends of the gusset 22 may be sealed into the side edge seals 21. As shown by way of example in FIG. 1 and in dash outline in FIG. 5, the gusset 22 adapts the bottom of the bag to spread out under contents load and permits the loaded bag to stand upright which may be a convenience for handling and storage.

It will be appreciated that for illustrative purposes material thicknesses may be substantially exaggerated since film thicknesses are generally measured in mils. As shown, the bag walls 18 and 19 are formed from a multiply material comprising an outer ply 23 and an inner ply 24 wherein the outer ply may be of a slightly thicker material than the inner ply and wherein the inner ply has desirable characteristics such as, but not limited to sealability, impermeability, and the like.

At the top of the bag, between the sealed side edges 20 is provided a bag mouth opening 25 through which access may be had to the interior of the bag. For closing the bag mouth opening means are provided comprising a substantial portion 27 on the wall projecting substantially upwardly above the upper edge of the wall 19 and thereby above the mouth opening 25. Extending across the upwardly projecting portion 27 is a bendable retainer or tie strip 28. The strip 28 may conveniently be a piece of wire formed from a suitable inexpensive malleable metal. For convenience the metal strip 28 may be incased in a narrow flat carrying medium or ribbon 29 formed from plastic, paper, fabric, or the like. Where the carrying medium 29 is heat sealable, or readily adhesively applied, it may be secured to the projecting portion 27 directly. However, it may be preferred to heat seal secure the carrier 29 and thereby the strip 28 to the portion 27 by means of a retaining strip or over-tape 30 which may be formed from the same material as the body of the bag 15 so that at the interface of the overtape 30 with the portion 27 a thorough heat seal bond will be attained. In the composite thus formed, the upwardly projecting portion 27 provides a lip of limited but ample width that can be rolled down over the top opening 25 and onto the outer face of the wall panel 19 for closing the bag mouth opening, whereafter, opposite ends of the bendable strip 28 are adapted to be bent into retaining locking relation to the outer face of the wall panel 18 for maintaining the bag closed.

To facilitate bag closing bending of the strip 28, and also to facilitate manufacture of the bag 15, clearance indentations 31 are provided in the side edges 20 of the bag to extend from adjacent to the lower edge of the upwardly extending lip portion 27 downwardly to a substantial distance below the bag mouth opening 25. This provides opposite end tab extensions 32 of the lip including the strip 28, and projecting into overhanging relation to the indentations 31. It may be noted in FIG. 4, especially, that the tab extensions 32 in their spread open condition have their tip ends aligned with the edge 20 at each side of the bag. This facilitates square stacking of the bag for packing, shipping and storage as compared with bags having retaining tabs which project beyond the side edges of the bags. Further, when the lip projection 27 is folded down, the length of the indentation or cut-out 31 in each instance is sufficient to permit a plurality of folddowns and then 180° bendovers of the extension tabs 32 for maintaining the bag closed, as visualized in FIGS. 1, 3 and in dash outline in FIG. 2. In FIG. 2 the tab extension 32 is depicted in full line before bending over to the retaining position in dash outline. It will be observed that a secure bag closure is attained by the multiple folds and the bent over extension tabs 32. As well visualized in FIGS. 1, 2 and 3, after the extension tabs 32 have been bent over into their retaining, locking position, they are located substantially inwardly relative to the side edges 20 of the bag so that interference therefrom with adjacent objects is avoided.

To reopen the bag 15, the extension tabs 32 are simply bent back toward their extended position and the rolled over closure unrolled or unfolded away from the bag mouth opening 25.

On reference to FIGS. 6 and 7, it may be noted that, although the bag body walls 18 and 19 may be secured together at the sides 20 by the seams 21, the opposite ends of the gusset may be sealed together at the edges 20, and the respective folds of the gusset sealed to the respective contiguous side wall 18 or 19 as the case may be, leaving the gusset folds separate to the edges 20 where the folds and the wall panels of the bag body are sealed together. This facilitates forming of a stand-up bottom for the bag under the weight of contents, as best visualized in FIGS. 1 and 5.

Figure 9:
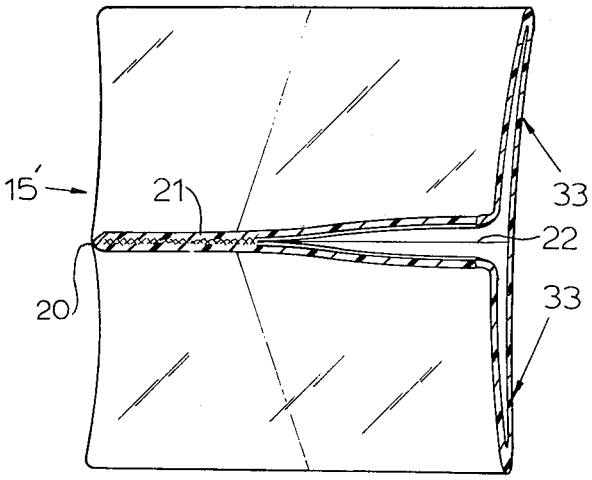
FIG. 9 is a fragmentary sectional detail view taken substantially along the line IX—IX of FIG. 8.

In FIGS. 8 and 9, the bag 15' is substantially like the bag 15 of FIG. 1 except that the bag bottom is modified to the extent that the ends of the gusset 22 are not connected at the bag edges 20 as was described in connection with the bag 15 of FIG. 1. Aside from that difference, the bag 15' is the same as the bag 15. As a result of the free spreadability of the ends of the gusset and the contiguous edge portions of the bag walls 18 and 19, a quite stable bottom support is provided by relatively oppositely spreadable bottom sections 33 under the weight of contents 34 in the bag 15' when the bag is set down on its bottom as shown in FIG. 8.

The bag 15, 15' is especially suitable for rapid, efficient, continuous, online, low cost production. Having reference to FIG. 10, the bag body material is supplied from a suitable source such as one or more rolls of sheet or film and fed to forming apparatus such as shapers and folders customarily employed for the purpose. Although the bag walls 18 and 19 may comprise separate sheets of material brought into face-to-face alignment and then joined along one longitudinal edge to provide for the closed gusset 22, a desirable procedure is to form the walls 18 and 19 including the material for the gusset 22 from a single monolithic sheet folded upon itself and the gusset 22 tucked-in between the bottom-forming portions of the side wall panel areas of the blank. Of course, in the course of forming the continuous bag configuration blank, the panel area of the blank to provide bag walls 18 will have its free edge portions oriented to extend the desired distance beyond the free edge of the bag wall area 19 to provide the projecting portion 27. After such orientation of the material has been effected, the ribbon 29 containing the bendable retainer or tie strip 28 is applied from a suitable source such as a roll in the desired orientation continuously in corunning relation to the portion 27. Where the ribbon 29 is compatible heat-seal coated or of a compatible heat-sealable material to the surface of the portion 27 to which applied, suitable heat sealing of the ribbon 29 directly to the portion 27 may be effected as by heated roller or the like (not shown). Where the ribbon 29 is not sealably or bondably compatible to the material of the portion 27, the tape 30 may be fed into position on the projection or lip portion 27 and bonded or sealed to the portion 27.

Figure 10:
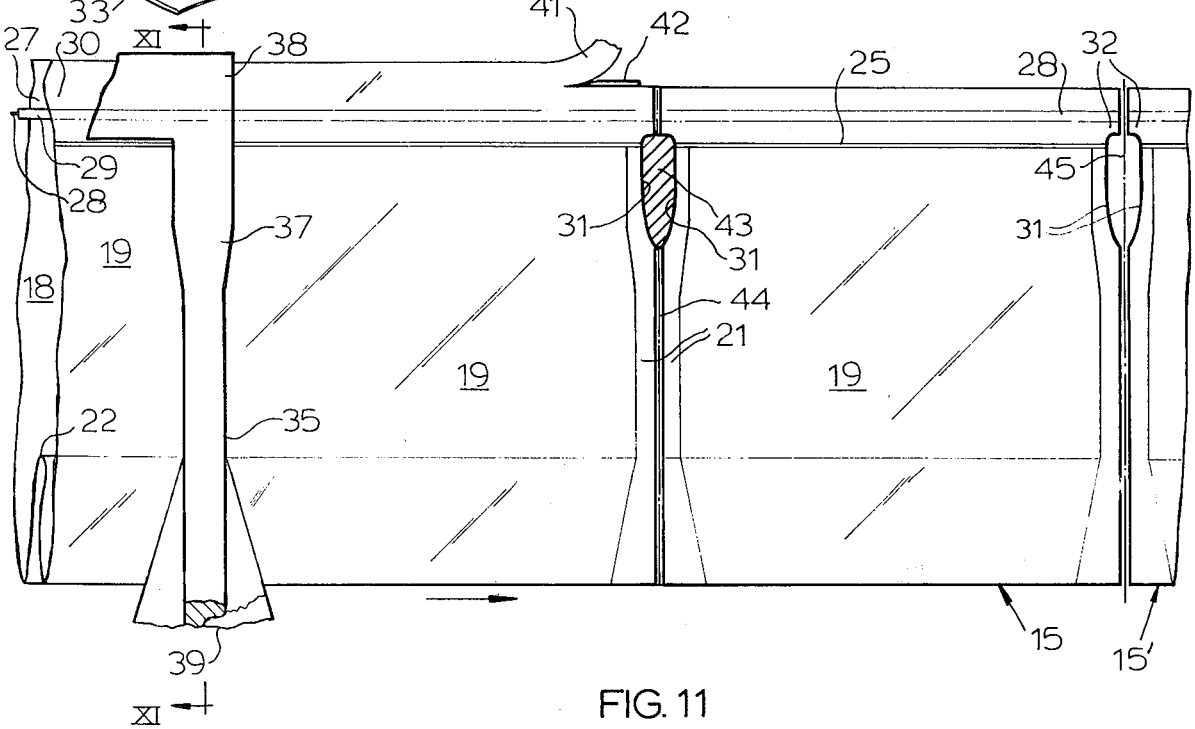
FIG. 10 is a schematic plan view demonstrating the method of making the bag.
Figure 11:
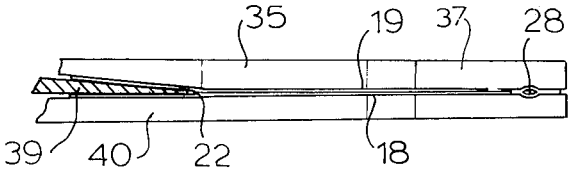
FIG. 11 is a sectional detail view taken substantially along the line XI—XI of FIG. 10.

In one desirable procedure, not only attachment of the tape 30 to the upper wall portion lip 27, but also form of the side seals 21 for the successive bags may be effected by heat sealing die means 35 which in each bag section advance of the bag forming blank functions to fuse the tape 30 in place and fuse the bag body material along transverse lines into the side seals 21. In forming the side seals 21, the area thereof contiguous to the place where the indentation cut-outs are to be formed is desirably of sufficiently greater width to assure that after the cut-outs are formed, the sides of the bags at the cut-outs will be thoroughly sealed. For this purpose, the sealing die 35 has a wider portion 37 where the wider bag side seal is to be provided. Sealing of the tape 30 is adapted to be effected by a sealing head 38 on the die 35.

Where the material of the bag-forming blank is of the type wherein the outer ply is of a non-heat sealable or at least high temperature resistant material and having an inner ply which includes a coating or a lamina of a heat sealable material, the sealing die means 35 will seal the gusset ends as well as the side seals 21 at the same time and without any need to maintain the confronting surfaces of the gusset folds separated. However, if the bag material including the outer surfaces thereof is of a thermoplastic nature, fusable at a heat sealing temperature, it may be desirable to employ a pressure plate member 39 inserted between the folds of the gusset 22 at what will be the gusset ends, substantially as shown in FIG. 9. A sealing die bar or anvil 40 may cooperate with the member 39 and the sealing die 35 to seal the underside portion of the gusset 22, where the die 35 seals the upperside of the gusset as shown in FIGS. 10 and 11.

In order to assure a straight, neat edge along the top of the laminated portion 27, 30 of the bag blank, this area of the blank is initially desirably formed slightly wider than necessary and the free edge portion trimmed off as scrap 41 by suitable trimming means 42, such as a rotary blade, trimming knife, or the like.

As the bag forming blank is advanced by suitable bag width sections, the clearance indentations or notches 31 are provided by releasing material in or from the indentation areas, as by means of a suitable punch die 43 which is dimensioned to release the material to provide the indentations 31 in the contiguous edges of the successive still-attached bag blanks, and centered on a tear seal line 44 extending transversely across the bag blank at each bag width interval centered between the side edge seals 21. If preferred, the die 43 may be combined with the heat sealing means 35 to punch out or otherwise release material in the clearance indentation area coordinated with operation of the heat sealing means.

After the die 43 has operated in coordinated relation with the die 35 (whether combined therewith or downstream therefrom), the blank material is advanced a bag section and the completed bag at the end of the bag blank stream is separated as by means of a shear or cut-off device 45, along the line 44. This also effects severing of the retainer or tie strip 28 along such line and at the ends of the bendable tabs 32 which thus are located within the lines of, i.e. aligned with, the side edges of the separated bags. After being separated from the bag making blank, each of the bags 15, 15' is stacked, packed, transported to a filling station, or the like, as may be preferred.

As shown in FIG. 4, the clearance indentations 31 may be provided by complete cut-out release of the material. However, it may be desirable in order to avoid any necessity for handling scrap material to effect only a partial release of the material in the indentation areas (FIG. 4A), sufficient to define the indentations adequately for accommodating the tab extensions 32 for their bag closure retention function. To this end, a bag 15'', which in general respects is the same as the bags 15 and 15' insofar as the bag mouth and closure structures are concerned, has a flap **31*a* of the material functionally released within the area of the indentation 31, by complete severance of the upper and lower ends of the flap from the remaining material of the bag so that the flap 31*a* is adapted to be bent over or folded back with the associated tab extension 32. To ease such bending of the flap 31*a***, it may be partially severed as by means of a line of roulette-like longitudinally aligned spaced slits where the flap joins the bag body between the lines of complete severance at the opposite ends of the flap.

Another modification in the bag 15'' may be the absence of gusset in the bag bottom. In other words, the bag 15'' thus has all of the attributes of the bags 15 and 15' without the gusset feature which is an optional feature in the bags.

It will be understood that variations and modifications may be effected without departing from the spirit and scope of the novel concepts of this invention.

I claim as my invention:

1. A bag of the type having opposed first and second bag walls with their opposite side edges sealed to one another in respective sealed areas adjacent each of such side edges, and with their bottom edges sealingly attached to one another to provide a bag having a top bag mouth opening, and comprising:

a substantial portion of said first bag wall projecting substantially upwardly as a lip above said second bag wall and thereby above said bag mouth opening;

a bendable retainer strip secured to, carried by, and extending across said lip;

a clearance indentation in each of such sealed side edges of said bag each indentation extending into but not beyond such sealed area and further extending from adjacent to the lower edge of said lip downwardly to a substantial distance below said bag mouth opening, thereby to define an end tab extension at each opposite end of said lip; and each of said opposite end tab extensions of said lip including said strip and projecting into overhanging relation to said indentations and said end tab extensions each having its respective tip end in alignment with its adjacent such side edge, so that said lip is adapted to be folded over into closing relation to said bag mouth opening and onto the outer face of said second wall, and said end tab extensions being then adapted to be bent over within said clearance indentations onto the outer face of said first wall for maintaining said bag closed, but permitting said bag to be reopened by bending said end tab extensions out of engagement with said first wall and unfolding said lip away from said bag mouth opening.

2. A bag according to claim 1, including a securing tape attached to said lip and securing said retainer strip in place on said lip and including said tab extensions.

3. A bag according to claim 1, wherein said clearance indentations are of a length permitting a plurality of folds of said lip with said retainer strip onto said outer face of said second wall.

4. A bag according to claim 1, including an upwardly infolded bottom gusset permitting the bottom of the bag to expand under the weight of bag contents to stand upright.

5. A bag according to claim 4, wherein opposite ends of said gusset are joined with the vertical edges of the bag walls.

6. A bag according to claim 4, wherein opposite ends of the gusset folds are sealed and the seal fold ends are free to spread apart and provide stabilizing bottom flanges for the bag bottom under the weight of bag contents for supporting the bag in upright position.

7. A method of making a bag of the type having opposed first and second bag walls with their opposite side edges sealed to one another in respective sealed areas adjacent each of such side edges and their bottom edges sealingly attached to one another to provide a bag having a top bag mouth opening, the method comprising:

providing said first bag wall with a substantial portion projecting substantially upwardly as a lip above said second bag wall and thereby above said bag mouth opening;

securing a bendable retainer strip to extend across said lip;

forming a clearance indentation in each of such sealed side edges of said bag to extend into but not beyond such sealed area and further extending from adjacent to the lower edge of said lip downwardly to a substantial distance below said bag mouth opening, thereby to define an end tab extension at each opposite end of said lip;

and thereby providing opposite end tab extensions of said lip including said strip projecting into overhanging relation to said indentations, and providing each of said extensions with a tip end which is in alignment with the adjacent said side edge, so that said lip is adapted to be folded over into closing relation to said bag mouth opening and onto the outer face of said second wall, and said end tab extensions being then adapted to be bent over within said clearance indentations onto the outer face of said first wall for maintaining said bag closed, but permitting said bag to be reopened by bending said tab extensions out of engagement with said first wall and unfolding said lip away from said bag mouth opening.

8. A method according to claim 7, comprising forming bag material into a continuous bag blank having first and second bag wall areas in separable laminar relation, applying said retainer strip as a continuous ribbon to said lip, sealing the bag forming blank at predetermined intervals along bag side edge lines across the width of the blank, releasing material from the blank and thereby forming said clearance indentations in the sides of contiguous joined bag sections and at each side of said edge lines, and separating successive bag sections from the blank along said side edge lines and including severing said retainer strip ribbon in alignment with said side edge lines.

9. A method according to claim 8, including applying and securing a tape to said lip and thereby securing said retainer strip ribbon to said lip.

10. A method according to claim 7, including forming the bag bottom with an infolded gusset adapted to spread under weight of bag contents for providing a stand-up base for the bag.

11. A method according to claim 10, comprising securing opposite ends of the gusset with the attached vertical edges of said bag walls.

12. A method according to claim 10, comprising sealing the opposite ends of the gusset folds separately and unattached to said bag wall vertical edges, so that the gusset folds can spread out as bag bottom stabilizing flanges under the weight of contents within the bag to facilitate upright standing of the bag.

13. A method according to claim 8, comprising effecting said sealing of the bag forming blank along a substantial width at each side of said edge lines, and to a greater width at each side of the clearance indentation area of the blank where material is released for forming the clearance indentations.

14. A method according to claim 7, comprising sealing said bag walls together along the side edges of the bag with seals of substantial width and including those portions of the side edges along said clearance indentations.

15. A method according the claim 7, comprising forming said clearance indentations by partially severing flaps which are adapted to be bent over with the associated tab extensions.

16. A bag according to claim 1, wherein said clearance indentations are formed with bendable flaps.

* * * * *